US006401686B1

(12) United States Patent
Prueitt et al.

(10) Patent No.: US 6,401,686 B1
(45) Date of Patent: Jun. 11, 2002

(54) APPARATUS USING OSCILLATING ROTATING PISTONS

(76) Inventors: Melvin L. Prueitt, 161 Cascabel, Los Alamos, NM (US) 87544; Leslie G. Speir, P.O. Box 4172, Espanola, NM (US) 87533; Stanley D. Prueitt, 2848 Walnut St., Los Alamos, NM (US) 87544

( * ) Notice: Subject to any disclaimer, the term of this patent is extended or adjusted under 35 U.S.C. 154(b) by 0 days.

(21) Appl. No.: 09/715,751

(22) Filed: Nov. 16, 2000

Related U.S. Application Data

(60) Provisional application No. 60/168,479, filed on Dec. 1, 1999.

(51) Int. Cl.[7] ..... F02B 53/00
(52) U.S. Cl. ..... 123/201; 123/243
(58) Field of Search ..... 123/201, 241, 123/242, 243, 18 R

(56) References Cited

U.S. PATENT DOCUMENTS

| | | | | |
|---|---|---|---|---|
| 526,127 A | | 9/1894 | Geiger | |
| 1,010,583 A | | 12/1911 | Carmichael et al. | |
| 1,326,684 A | * | 12/1919 | Newland | 123/201 |
| 2,359,819 A | | 10/1944 | Bachrach | 103/145 |
| 2,786,455 A | | 3/1957 | McDonnell et al. | 121/97 |
| 2,870,748 A | | 1/1959 | Hemphill | 121/97 |
| 2,989,040 A | | 6/1961 | Zalisko | 121/18 |
| 3,181,513 A | | 5/1965 | Young | 123/18 |
| 3,215,045 A | | 11/1965 | Lissau | 91/388 |
| 3,282,513 A | | 11/1966 | Savage | 239/534 |
| 3,315,648 A | | 4/1967 | Del Castillo | 123/18 |
| 3,741,694 A | | 6/1973 | Parsons | 418/61 |
| 4,002,033 A | | 1/1977 | Welch | 60/682 |
| 4,099,448 A | | 7/1978 | Young | 91/339 |
| 4,938,668 A | | 7/1990 | Schukey | 418/38 |
| 5,086,732 A | * | 2/1992 | Seno | 123/18 R |
| 5,138,994 A | | 8/1992 | Maday | 123/248 |
| 5,228,414 A | | 7/1993 | Crawford | 123/18 R |
| 5,803,041 A | | 9/1998 | Motakef | 123/225 |
| 5,813,372 A | | 9/1998 | Manthey | 123/43 A |

* cited by examiner

*Primary Examiner*—Hoang Nguyen
(74) *Attorney, Agent, or Firm*—Rod D. Baker

(57) ABSTRACT

A motor, expander, compressor, or hydraulic device is formed with an oscillating rotating piston comprising a cylinder having an axis of rotation and end surfaces and defining an oscillating compression volume and an expansion volume. An axial sealing member separates the compression volume and the expansion volume, and seal members seal the end surfaces of the piston. Valves operate to close the compression volume and open the expansion volume at each oscillation of the piston. Means are provided for reversing the rotation of the cylinder at the end of a compression cycle of the piston. One or more pistons may be provided that contact other pistons along axial surfaces to form axial seal surfaces with rolling contacts that reduce friction energy losses.

21 Claims, 7 Drawing Sheets

APPARATUS USING OSCILLATING ROTATING PISTONS

CROSS-REFERENCE TO RELATED APPLICATIONS

This application claims the benefit of the filing of U.S. Provisional Patent Application Ser. No. 60,168,479, entitled "Apparatus Using Oscillating Rotating Piston," filed on Dec. 1, 1999, and the specification thereof is incorporated herein by reference.

BACKGROUND OF THE INVENTION

1. Field of the Invention

The present invention relates generally to piston operated devices, and, more particularly, to motors, expanders, compressors, and hydraulics having rotating cylinders.

2. Background Art

The world is running on internal combustion engines. For over a century, internal combustion gasoline and diesel engines, turbines, and Stirling engines have been used. More recently the Wankel engine was developed.

The response time of turbines and Stirling engines is too slow for automobile use. Wankel engines have fallen out of favor. Gasoline and diesel motors have been the mainstays of the auto industry in spite of low efficiency. Considering the combustion temperatures in these motors, the theoretical efficiency (Carnot efficiency) should be above 70%. Typically the efficiency of today's automobile motors is 25%. One of the chief reasons for the low efficiency is the high-energy losses due to sliding friction of the pistons against cylinder walls. This loss is turned into heat and carried away by the cooling water around the engine block.

Piston engines have been functioning since the early days of steam powered devices. Standard internal combustion engines are everywhere. Variations of the internal combustion engine are the Wankel motor and rotary piston engine such as that described in U.S. Pat. Nos. 3,741,694. 5,813,372 describes a rotary piston engine in which internal friction is reduced since the pistons do not touch the cylinder walls. Only piston rings touch the walls. The cylinders and pistons rotate around an axis and rely on a sliding valve arrangement to open ports for intake and exhaust. The difficulty with this device is that the large sliding surfaces of the head past the valve ports supply a large amount of friction.

U.S. Pat. No. 5,803,041 describes a rotary engine in which linear piston motion is translated into rotary motion of the cylinder.

U.S. Pat. No. 5,138,994 describes a rotary piston engine in which a rectangular piston rotates in an annular cavity. As the piston rotates continuously in one direction, a gate that blocks the annular cavity opens once during each revolution of the piston to allow the piston to pass. The piston is connected to a central shaft by a disk that penetrates the inner cylindrical wall of the cavity. The problem with this device is that large sliding friction forces occur all the way around the rotary piston as it rubs against cylinder walls. Additional friction occurs where the disk penetrates the cylindrical wall.

U.S. Pat. No. 4,938,668 shows a rotating piston design in which two sets of rotating pistons oscillate together and apart forming cavities that change in volume as the two sets of pistons rotate around a common shaft. A cam system provides the thrust that drives the shaft. The pistons slide against an end plate in which are located intake and exhaust ports. This device would also have large sliding friction as the rotating pistons rub against the outer cylinder and against the end plates where the ports are located.

U.S. Pat. No. 4,002,033 is a rotary displacer that has a rotary-abutment sealing rotor that rotates against the main rotary piston. However, there is a slight space between the sealing rotor and the rotary piston, since the surface speeds are different. They both rotate at the same angular velocity, but since their diameters are different, the abutting surface velocities are different. The rotary piston does not touch the walls of the cylinder to eliminate sliding friction. This allows for excessive blow-by. To reduce the blow-by, grooves are formed in the piston walls to create turbulence in the gas flow. Blow-by is still a problem with this design.

U.S. Pat. No. 4,099,448 shows, rotating vanes that have rotating gears about the axes that keep the vanes synchronous. Sliding friction is prominent in this design, since the outer tips of the vanes have seals that slide on the cylinder walls.

U.S. Pat. No. 3,282,513 describes an engine that has rotating vanes that have sliding seals at the end of the vanes, which slide on cylinder walls. Lubricating oil must be supplied to the seals from the central rotating shafts. This device has some features in common with our single cylinder engine, but our single-cylinder engine has the seals mounted in the wall of the cylinder rather than in the rotating piston, and lubricating oil can be supplied from outside the cylinder rather than through the shaft and piston.

U.S. Pat. No. 2,359,819 is a pump that has sliding seals at cylinder walls. Similarly, U.S. Pat. Nos. 5,228,414, 3,315,648, 3,181,513, 2,989,040, 2,786,455, 1,010,583, and 526,127 describe designs that have rotating members that have seals that slide on cylinder walls.

Since oil supplies are being depleted and the atmosphere is being polluted with greenhouse gases, it is long past time for today's gasoline engines to be replaced by a more efficient power plant. In accordance with the present invention, which is called "MECH", (acronym for motor, expander, compressor, or hydraulics) a new fluid displacement machine is provided that, with appropriate modifications, can function as an internal combustion engine, an expander (analogous to a turbine), a compressor, a hydraulic motor, or a pump. MECH incorporates rolling friction rather than sliding friction.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the present invention is a motor, expander, compressor, or hydraulic device having in one embodiment an oscillating rotating piston comprising a partial-cylindrical piston having an axis of rotation and end surfaces and defining an oscillating compression volume and expansion volume. An axial sealing member separates the compression volume and the expansion volume and radial seal members seal the end surfaces of the piston. Valves operate to close the compression volume and open the expansion volume at each oscillation of the piston. Means are provided for reversing the rotation of the piston at the end of each cycle of the piston. In advanced embodiments, one or more pistons may be provided that contact other pistons along axial surfaces to form axial seal surfaces with rolling contacts.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION OF THE PREFERRED EMBODIMENTS

As used herein, the term "MECH" means a motor, expander, compressor, or hydraulics, including two-cycle and four-cycle gasoline and diesel engines. The present invention provides internal friction losses that are much less than those of standard engines. Thus, operating efficiencies and fuel economy are significantly better.

For the same volume of engine, the inventive MECH has four times the displacement of an ordinary gasoline motor, which translates to four times the power. But since MECH has less friction loss, it is projected that a MECH engine would have five times the power of the same size gasoline motor. Or conversely, a MECH engine would weigh about one-fifth the weight of a gasoline engine for the same power.

A MECH engine can be used as the power plant of a car or truck, or it can be used as the power source in a hybrid automobile. MECH engines can also be manufactured for lawn mowers, motorcycles, electric power generators. Their lightweight would make them attractive for chain saws and other handheld power equipment. Large MECH diesel or gasoline engines can used in electric power plants. Home or business self-generation units can be constructed using small MECH engines.

It is known that rolling friction is much less than sliding friction. Pistons sliding in cylinders have high friction losses. In the present invention, rolling friction is involved when two rotating pistons roll together, rather than slide along their longitudinal axes. Most people associate the word "piston" with a cylindrical object that slides axially in a cylinder. In the present description, a "rotating piston" is defined to be a partial cylinder that oscillates in a rotating manner about an axis. It does not translate axially. The rotating piston actually rotates within the cylinder in contrast to a "rotary piston" (described in some prior art) in which the piston and cylinder rotate about some external axis. "Cylinder" in this specification and claims is used in the general sense of a "piston chamber", and may include chambers having other than a strictly cylindrical shape.

Figure 1:
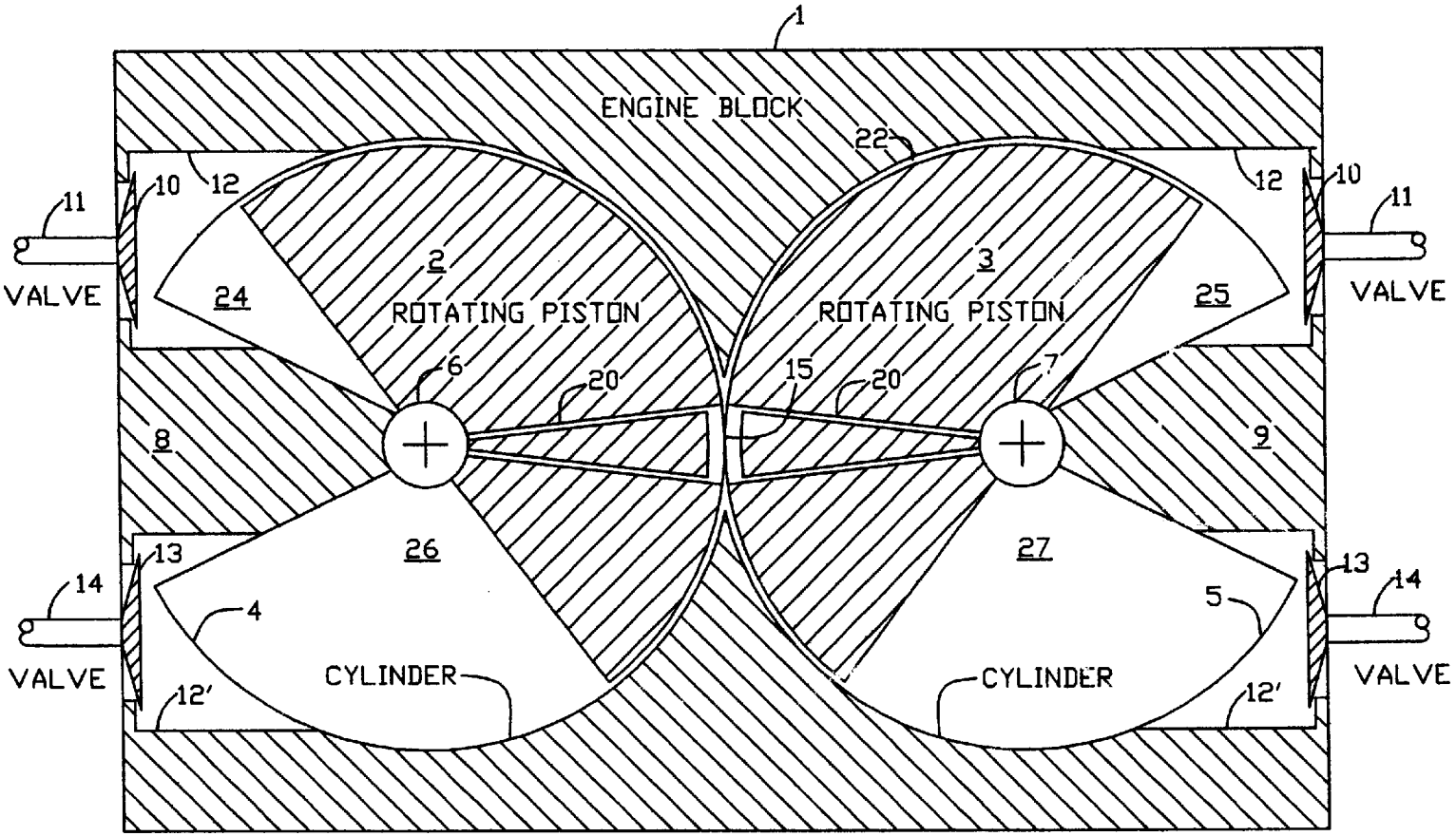
FIG. 1 is a radial cross-sectional view of a four-cycle engine according to one embodiment of the present invention.

FIG. 1 shows the concept of a MECH four-cycle internal combustion engine. In engine block 1, rotating pistons 2 and 3 rotate in an oscillating manner about shafts 6 and 7 in cylinders 4 and 5 and roll together at contact point 15 (actually a "contact line"). This rolling contact point forms an axial rolling seal that prevents gases from passing between the lower chambers 26, 27 and upper chambers 24, 25. This rolling seal has much less friction than a sliding seal. Note that the pressure in upper chamber 24 is about the same as that in upper chamber 25, and the pressure in lower chamber 26 is about the same as the pressure in lower chamber 27, so that there would be little tendency for gas to flow through gap 22. It is seen therefore, that the shafts 6, 7 are coaxial with the axes of the cylinders, and the pistons pivot eccentrically about an axis of rotation defined by, and essentially coaxial with, the shafts.

In this specification and in the claims, "eccentric" refers to a piston having its axis of rotation—or more specifically to this application, its pivotal axis—displaced from its center of gravity so that it is capable of imparting reciprocating motion. Ordinarily in the invention, a piston's pivotal axis is parallel to, but offset from, the piston's longitudinal axis running through its center of gravity. Thus, as a piston pivots "eccentrically," the bulk of its mass is always offset from its pivotal axis, although the piston's center of gravity reciprocates along an arc concentric to the pivotal axis.

The rotating pistons shown in the FIG. 1 are hemi-cylindrical. That is, the angle drawn from one face to the other is 180 degrees. This angle can be varied to suit the application, and while 180 degrees is preferable for some applications the hemi-cylindrical shape shown in the figures is by way of example rather than limitation. The wedges 8 and 9 can also be varied in angle for different applications. Gap 22 between the rotating pistons 2, 3 and the cylinder walls should be large enough so that the rotating pistons do not rub the walls. The gap 22 should be large enough to prevent the quenching of combustion, which would lead to hydrocarbon emissions.

End plates (not shown in FIG. 1) cover the ends of the rotating pistons 2, 3 and are secured to the engine block 1. Sliding friction occurs between the ends of the rotating pistons and the end plates, but this friction is relatively small since the rotating pistons 2, 3 can be very long compared to their diameter. For example, the cylinder diameter might be four inches, while the length might be two or three feet. Installing radial end seals 20 in grooves in the end plates can reduce this sliding friction further by eliminating the need to have the pistons tightly pressed against the end plates. These seals 20 are similar to piston rings in ordinary motors. End seals 20 are "U" shaped with the bottom ends abutted and the opposite ends pressed against the shafts 6 and 7. Oil can be injected between the end seals. Springs (not shown) within the end plate grooves bias the seals 22 against the ends of the rotating pistons.

In operation, as rotating piston 3 rotates clockwise, piston 2 rotates counterclockwise, and the fuel-air mixtures in upper chambers 24 and 25 are compressed. When compression is complete, a spark plug (not shown) fires and ignites the fuel-air mixture. The explosive pressure reverses the direction of rotation of the rotating pistons 2, 3. The counter-rotating pistons compress the fuel-air mixtures in lower chambers 26 and 27. Ignition in chambers 26 and 27 then again reverses the direction of the rotating pistons 2, 3. Valve rods 11, actuated by cams (not shown) open upper valves 10 and allow exhaust gases to escape from upper chambers 24 and 25 through upper channels 12 and past upper valves 10. (By "upper" and "lower" in this description, we mean the upper and lower parts of the drawing, not necessarily upper and lower parts of a physical machine). If a piston is very long, more than one intake and exhaust valve and spark plug may be advantageous; all embodiments of the invention functioning as an internal combustion engine may optionally feature more than one spark plug, more than one intake valve, and more than one exhaust valve per chamber.

During the next cycle, rods 14 open lower valves 13 to allow exhaust gases to escape from lower chambers 26 and 27 via lower channels 12' while a new fuel-air mixture is drawn into upper chambers 24 and 25 through intake valves. These intake valves are located directly behind the exhaust valves 10 (further into the page) and are thus not shown. Similar intake valves are located behind lower valves 13. The cycles repeat.

Figure 2:
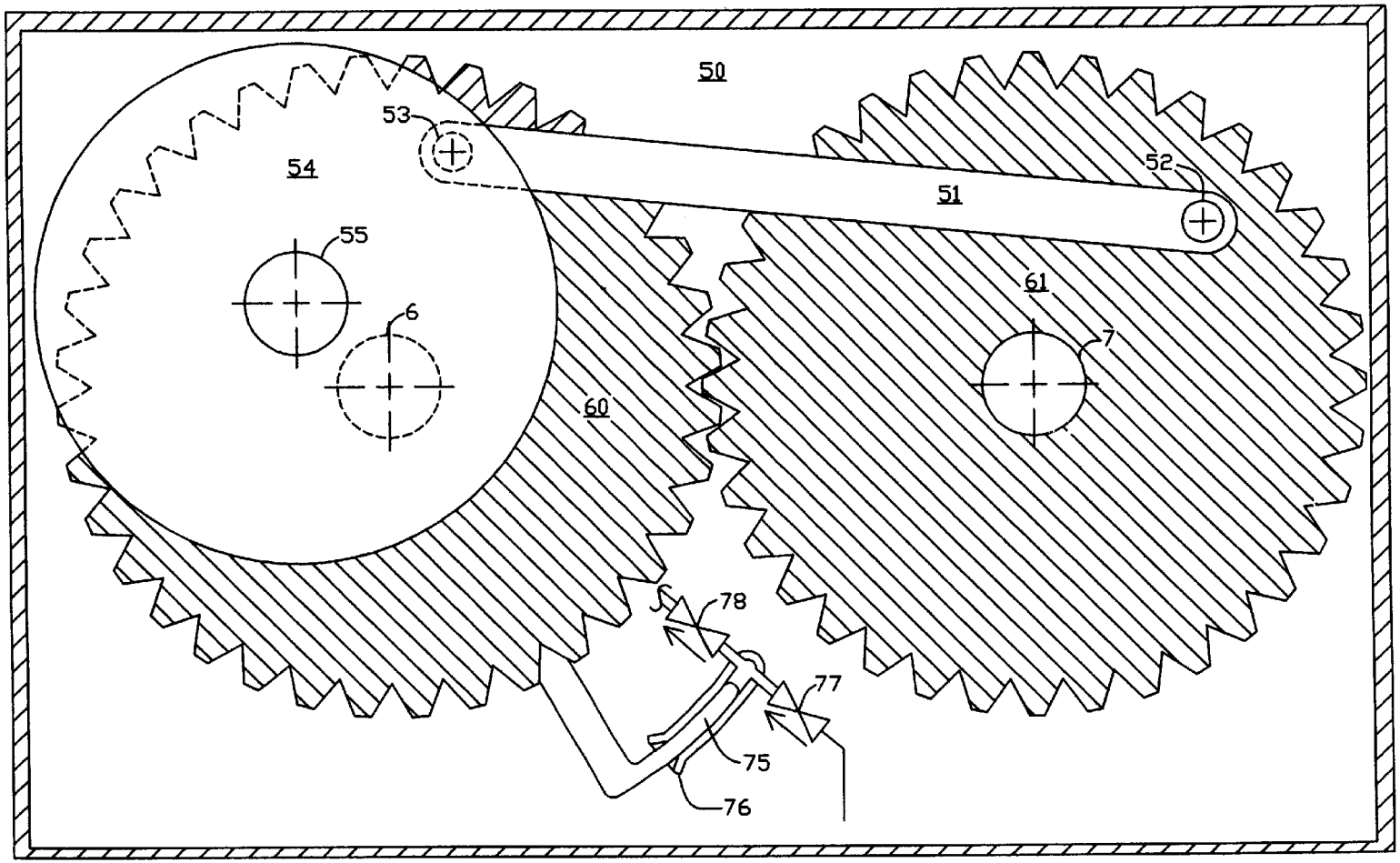
FIG. 2 is an end view of one embodiment of the invention, showing a crank for converting oscillating motion to continuous rotary motion.

FIG. 2 shows end plate 50 and the mechanism that is located on the end plate. This end plate attaches to the end of the engine block 1 and abuts the ends of the rotating pistons 2, 3. Shafts 6 and 7 from FIG. 1 extend through the end plate 50 and are attached to gearwheel 60 and gearwheel 61. These gearwheels have gear teeth on their circumferences that mesh to maintain gearwheels in 60 and 61 in proper mutual orientation. The purpose of this gear meshing is to prevent slippage of the rotating pistons 2 and 3 as they roll together. The gears also transmit energy from gearwheel 60 to gearwheel 61 so that this energy can be transmitted to the crank rod 51, which is pivotally attached to gearwheel 61 by shaft 52. Crank rod 51 then drives flywheel 54 by pivoting shaft 53. (The phantom lines of 53 and the end of the crank rod 51 mean that these parts are beneath the flywheel 54 from the viewer's perspective.) Crankshaft 55 is connected to flywheel 54 and carries power from the engine to the exterior. The crankshaft 55 exits through the engine housing (not shown) that is on the viewer's side of FIG. 2.

The oil pump consists of a plunger 75 (a curved rod) and curved chamber 76. Plunger 75 is attached to one of the gearwheels. As the gearwheel oscillates, plunger 75 plunges into chamber 76 and forces oil (which rests in the housing in which the gearwheels are located) to flow through the check valve 78. The oil is piped to wherever it is needed. Check valve 77 allows oil to flow into chamber 76.

The end plate on the opposite end of the engine block 1 may have a similar gear mechanism, but it is not required. That end plate provides bearings for shafts 6 and 7 and end seals 20. The engine needs a starter, intake and exhaust manifold, ignition wiring, timing chain, valve cams, and other items common to gasoline or diesel motors. For clarity, these items are not added to the figures. Water flowing through channels in the engine block 1 can cool the engine. These channels are not shown. They can be added by those skilled in the art.

One of the important advantages of the MECH engine is that the cylinder walls and the rotating pistons can be very hot, since the rotating pistons do not touch the cylinder walls and no lubrication is required there. If the surfaces are very hot, less heat will be lost from the burning gases to the surfaces. This will provide greater fuel economy. In ordinary internal combustion engines, a large fraction of the fuel energy is lost to the cylinder walls and carried away by cooling water to the radiator. In MECH, the end plates will require cooling, since lubrication is applied there. Internal gaps in the walls can provide insulation between the hot cylinder walls and the end plates. Heat from the gases will be lost to the end plates, but if the cylinders are long compared to the diameter, this loss will be relatively small.

Figure 3:
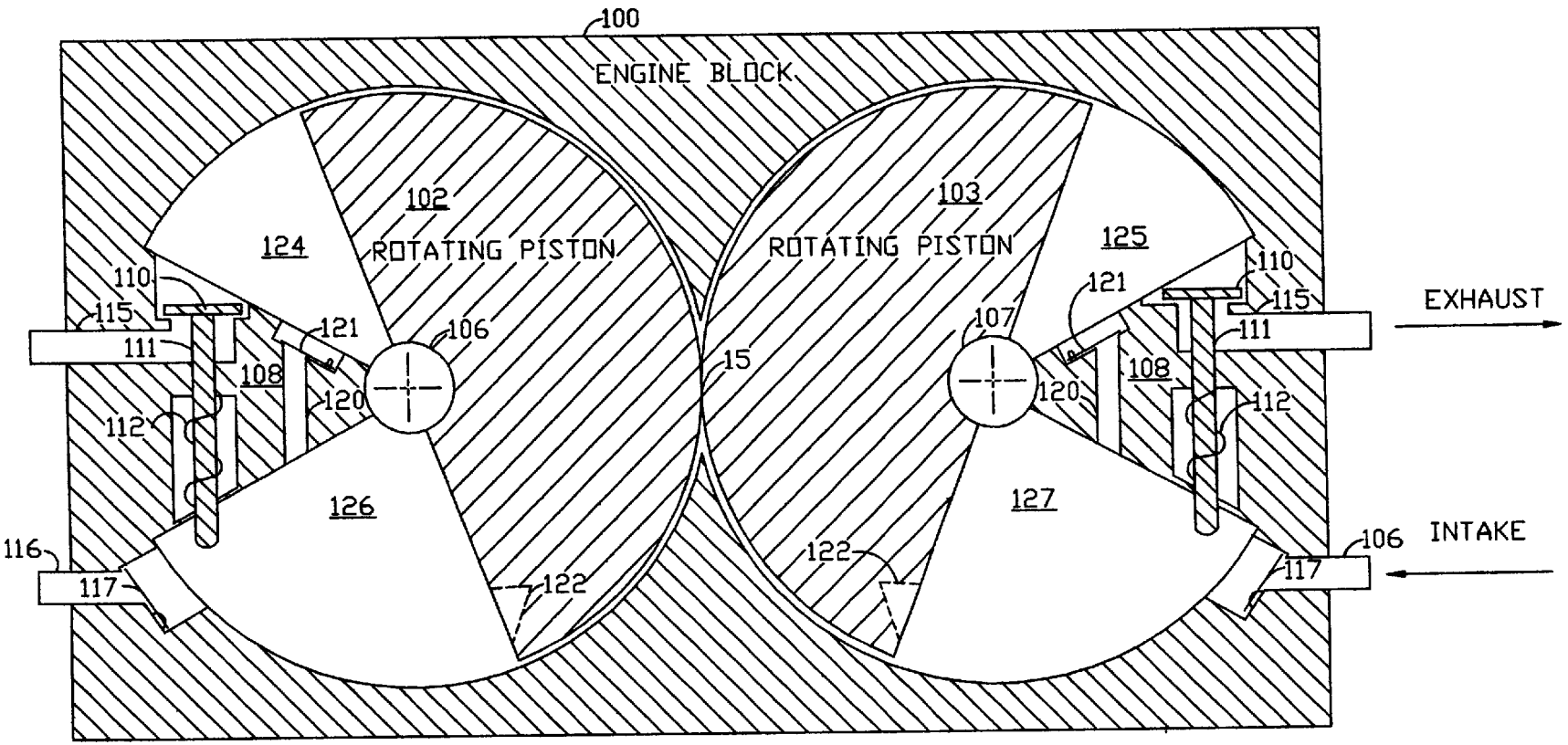
FIG. 3 is a radial cross-sectional view of a two-cycle engine according to another embodiment of the present invention.

In FIG. 3, showing a two-cycle engine, fuel-air mixture is drawn through tubes 106 and 116 in engine block 100, past reed valves 117 (or other type of check valve) into lower chambers 126 and 127 as rotating piston 102 rotates counterclockwise and rotating piston 103 rotates clockwise. Fuel-air mixtures in upper chambers 124 and 125 are compressed. At the completion of compression, spark plugs (not shown) fire, and the explosion forces the rotating pistons 102, 103 to reverse directions. Reed valves 117 close and the gases in lower chambers 126 and 127 are compressed.

When the rotating pistons approach the end of a cycle, they contact the ends of shafts 111 at points 122, which are cutouts in the face of the pistons to provide near-normal contact. This forces valves 110 to open allowing exhaust gases from upper chambers 124 and 125 to exit through tubes 115. Reduction of pressure in upper chambers 124 and 125 allows compressed gases in lower chambers 126 and 127 to pass through interior channels 120 through reed valves (or other types of check valves) 121 into upper chambers 124 and 125. By having valves 121 at one end of the cylinders defined in the engine block 100 and exhaust valves 110 at the other end, the gas flowing in through 121 will tend to purge the exhaust gases and fill the upper chambers 124 and 125 with fresh fuel-air mixtures. Thus, the channels 120 and valves 121 preferably are located in the wedge 108 near the periphery of the cylinder (behind the exhaust valve 110 in the drawing), but for the sake of clarity of illustration, it is shown in the narrower part of the wedge 108 as though the channels 120 and valves 121 were at the same end of the cylinder.

When the rotating pistons 102, 103 again reverse direction, springs 112 cause valves 110 to close so that the trapped gases in upper chambers 124 and 125 will again be compressed. The cycles are repeated.

A two-cycle MECH engine will be similar to the four-cycle MECH engine in other respects. That is, it will have a mechanism similar to that of FIG. 2 on one end plate, and it will have end seals 20 as seen in FIG. 1, but which are not seen in FIG. 3. Rolling contact point 15 provides a seal to prevent gas flow from high-pressure chambers to low-pressure chambers.

When a high-pressure gas (such as steam, air, refrigerant vapor, etc.) is available, an expander can extract energy from the expansion of the gas to a lower pressure. Turbines are typically regarded as the expanders in steam power plants. MECH units with the appropriate construction can also serve as expanders.

Industry has used rotary vane, geroter, gear motor, and screw expanders for various applications. These devices typically have high internal friction and excessive blow-by. This leads to low volumetric efficiency. MECH expanders would have low internal friction and much lower blow-by.

MECH expanders would be much less expensive to build than turbines and could be used for steam, compressed air, and low-boiling point fluids. A similar configuration can be used as a hydraulic motor. For applications such as driving irrigation pumps or other pump applications, the MECH expander can be coupled directly to a MECH pump without having to have a generator and electric motor to drive a pump. When an expander drives a generator, which drives a motor, which drives a pump, the inefficiencies of this series of the devices are multiplied together.

Figure 4:
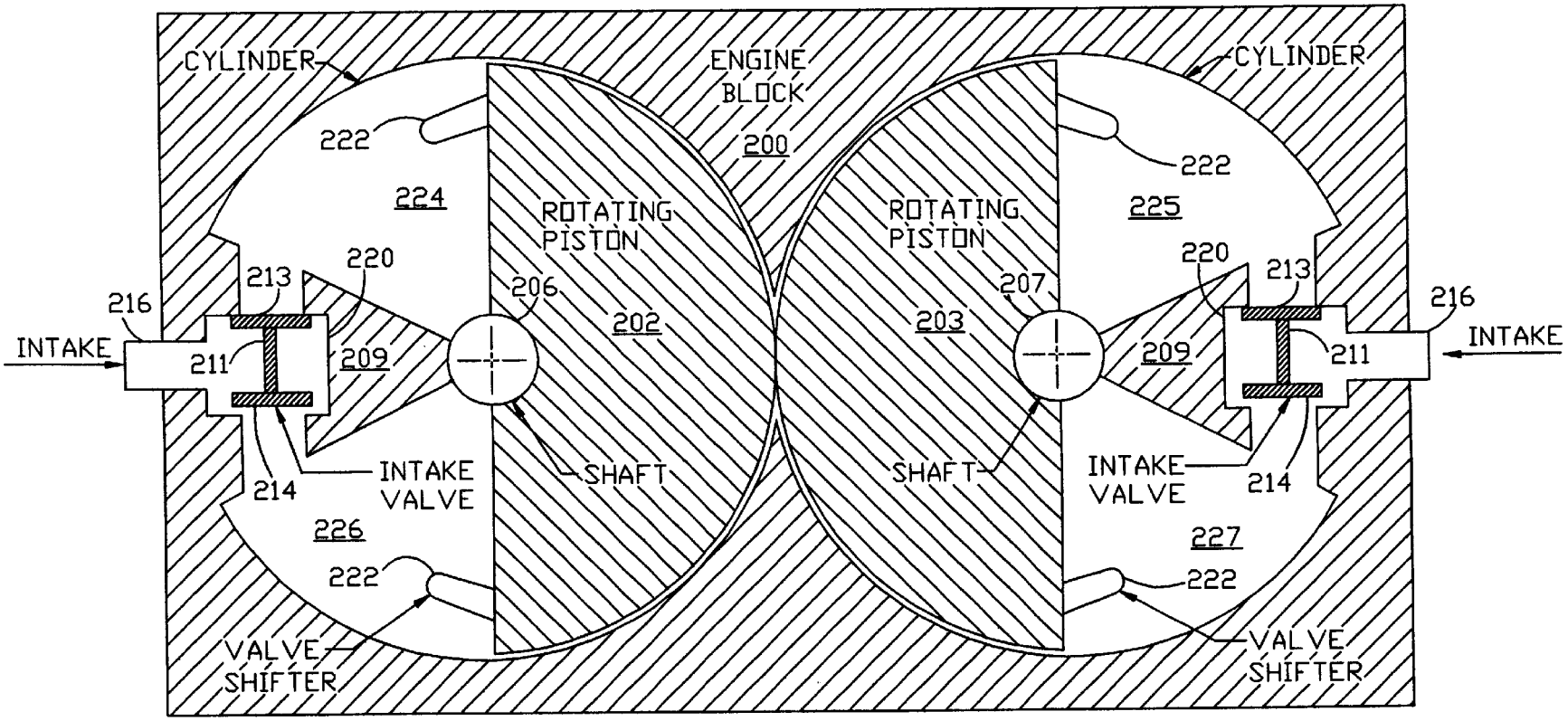
FIG. 4 is a radial cross-sectional view of an expander according to one embodiment of the present invention.

FIG. 4 shows a MECH expander. Steam, air, or other high-pressure gas enters the intake tubes 216, passes through valve assemblies 220, and flows into lower chambers 226, 227, when valves 214 are open, and drives rotating pistons 202 and 203 in opposite directions about shafts 206, 207. When pistons 202 and 203 approach the end of their stroke, valve shifters 222 strike valves 213 and force valves 214 to close and valves 213 to open. High-pressure gas then enters upper chambers 224, 225 via intake tubes 116 and reverses the direction of rotation of the rotating pistons 202, 203. The valve assemblies 220 are located in wedges 209 that separate upper chambers 224, 225 from lower chambers 226, 227. High-pressure gas tends to hold the valves 211 in one position until the rotating pistons 202, 203 shift them to the other positions.

Figure 5:
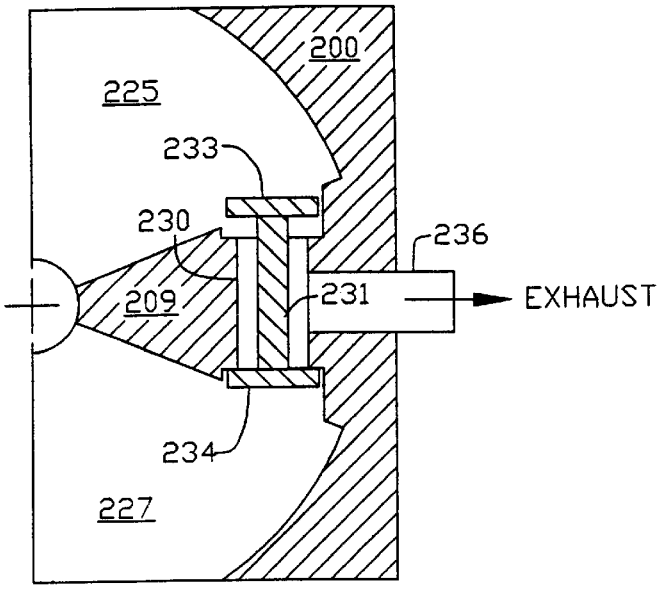
FIG. 5 is an enlarged view of and more particularly depicts an exhaust valve arrangement for the expander shown in FIG. 4.

FIG. 5 shows an exhaust valve assembly 230, which is located behind valve assembly 220 in FIG. 4. When high-pressure gas is entering lower chamber 227, gas is exhausting from upper chamber 225 through exhaust valve assembly 230 past valve 233 and into exhaust tube 236. Valve shifters like 222 (FIG. 4) strike the exhaust valves 231 at the end of each stroke to alternately open and close valves 233 and 234 by rod 231.

The MECH expander has an end assembly like that of FIG. 2 and has other similarities to the MECH internal combustion engine.

The MECH expander of FIG. 4 can also function as a hydraulic motor. For an expander engine such as this, there is the possibility that when the high pressure gas supply is shut off, the pistons or the valves might stop in such a position that the engine would not start when the pressure is turned on again. A starter may be required.

An alternative valve system for the expander would be a crankshaft-driven cam that opens spring-loaded valves. This method would allow the intake valve to close before the piston reached the end of its stroke to allow adiabatic expansion of the gas for better efficiency.

The people of China, India, and other developing nations increasingly seek the benefits of air conditioning. Factories cannot keep up with the demand. A major problem is that the power grids and power plants in those countries do not have the capacity to provide the necessary power for all the new air conditioners. Even in the U.S., power brownouts have occurred in California and New York on hot days. A more efficient air conditioner would alleviate these problems.

Refrigerant compressors are the main energy consumers in refrigeration equipment and air conditioners. Piston compressors have high internal friction. Scroll, rotary vane, and screw compressors have high friction and excessive blow-by. The inventive MECH compressors would solve these difficulties. Small, compact, MECH compressors can be built for refrigerators, while large units can be manufactured for large air conditioners.

Figure 6:
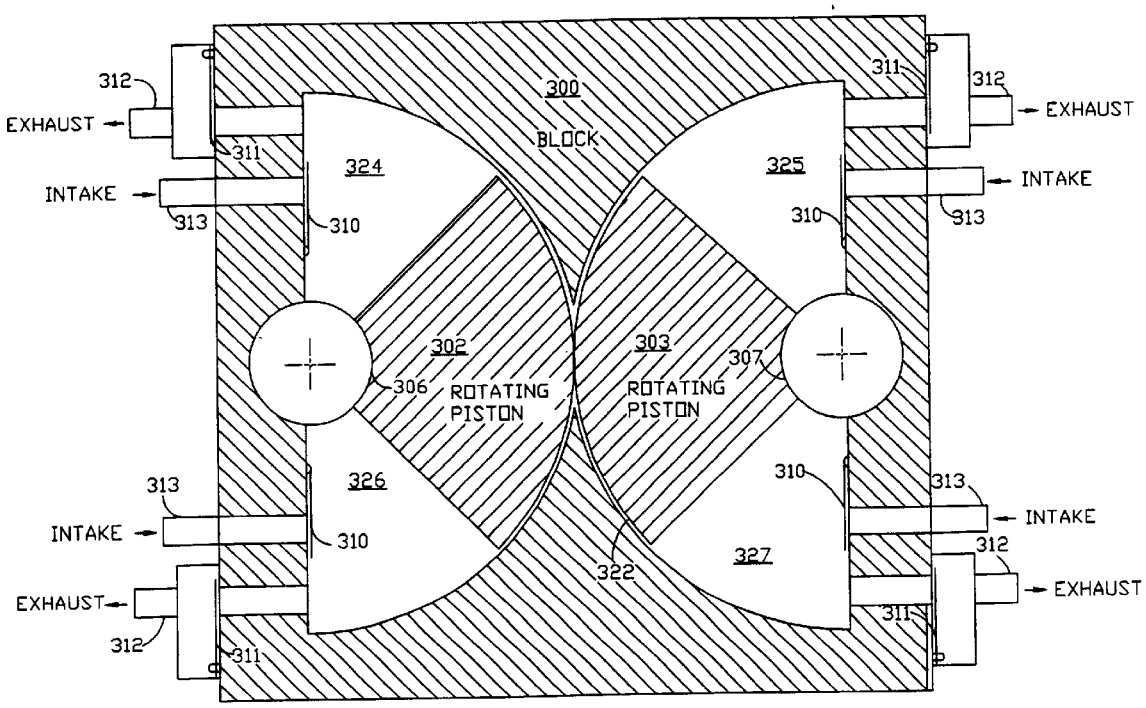
FIG. 6 is a radial cross-sectional view of a compressor according to another embodiment of the present invention.

FIG. 6 is a schematic of a MECH compressor. The rotating pistons are shown as quadrants of cylinders with the angle from face-to-face of about 90 degrees. The face-to-face angle could be 180 degrees as shown in the previous figures, or some other angle, but it is depicted in FIG. 6 at 90 degrees to demonstrate the flexibility of design parameters for MECH geometries.

In block 300, rotating piston 302 alternately compresses gas in chambers 324 and 326, while rotating piston 303 alternately compresses gas in chambers 325 and 327. When a particular piston face is receding, gas is drawn into the corresponding chamber past reed valves 310 (or other type of check valve) through tubes 313. When the gas is compressed, valves 310 close, and the gas is forced out past reed valves 311 and through tubes 312.

The gear mechanism on the end plate is similar to that shown in FIG. 2, but the gear wheels 60 and 61 could be only half-wheels (that is, 180 degrees) if the rotating pistons 302, 303 are only quadrants of a cylinder, and the stroke length of the crankshaft would be less. In this case, power is input to the crankshaft, and the crankshaft drives the rotating pistons to compress the gas.

This design also serves as a liquid pump. For liquids, gap 322 is not excessively small so that resistance to piston motion would not be large. The intake and exhaust tubes could be larger.

For a compressor or liquid pump, a MECH motor or expander can be used to drive a MECH compressor or pump directly. For example, if an expander is the driver, shafts 206 and 207 of FIG. 4 extend into the compressor and become shafts 306 and 307 of FIG. 6. A crank rod and crankshaft are not necessary.

Figure 7:
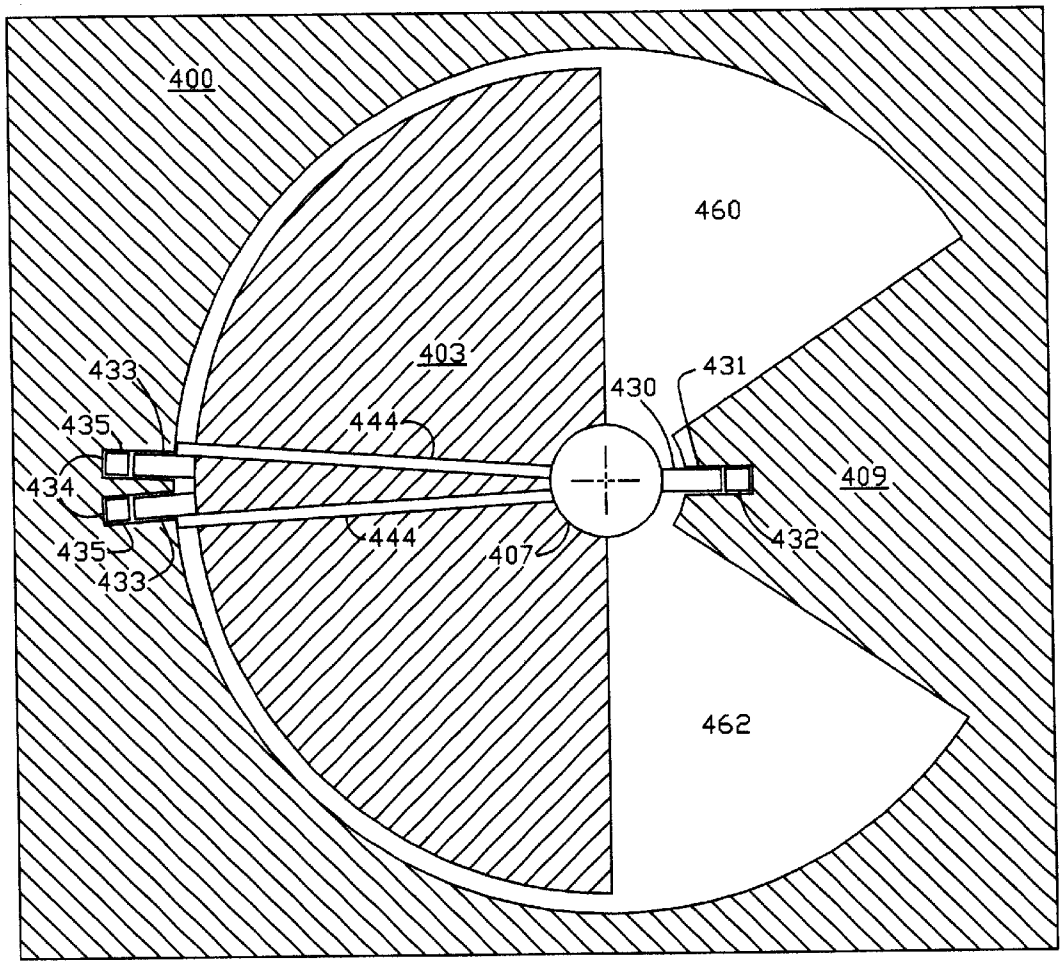
FIG. 7 is a radial cross-sectional view of a single rotary piston for use in various applications of the present invention.

FIG. 7 shows a single piston embodiment of a MECH useful for a motor, expander, or compressor. Rather than have two pistons that roll together, one rotating piston 403 in block 400 has seals 433 to prevent gases from flowing from one chamber 460 to the other 462. These seals are similar to the piston rings in a car engine, but are straight. Seals 433 are free to slide in slots 434 and are forced by serpentine strip springs 435 to press radially inward against the rotating piston. Oil can be injected between the two seals for lubrication. The ends of these seals 433 are placed next to the ends of seals 444 that are in slots in the end plates (not shown). This design does not exploit the advantage of rolling friction, but does provide a compact engine of high power density.

A similar seal 430 in slot 431 in wedge 409 prevents blow-by past the shaft 407. Serpentine spring 432 presses the seal against the shaft. Valves are not shown in this figure, since the design is applicable to the different configurations of MECH. This design can be adapted to multiple rotating pistons in a single block, but each rotating piston and its cylinder would be separated from the others.

Figure 8:
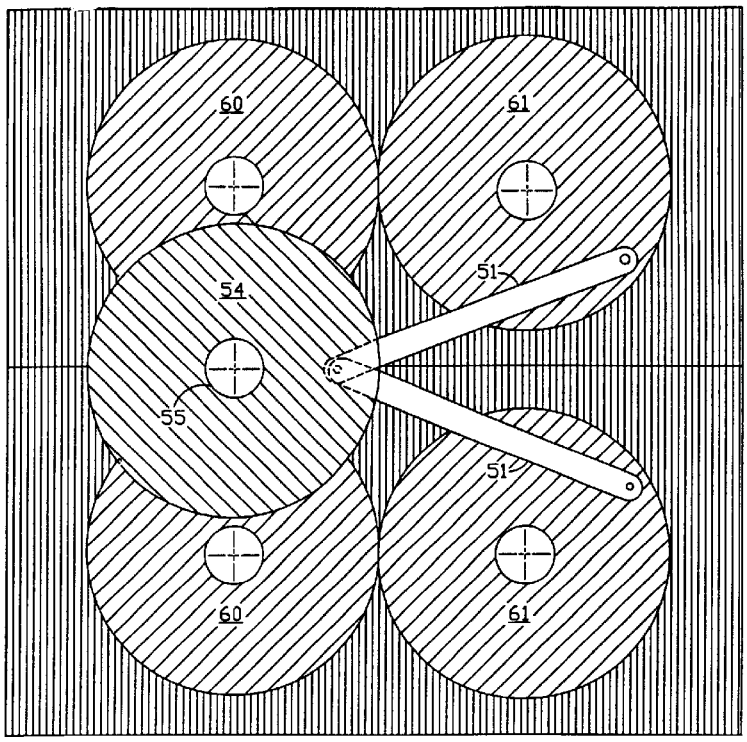
FIG. 8 is radial cross-sectional view of a crank design for a four-piston configuration of the present invention.

Counterweights may be attached to the gear wheels 60 and 61 in FIG. 2 (and their counter parts in other embodiments) to reduce vibration of the engine due to the motion of the rotating pistons. Being made hollow can make the pistons lighter. If the motor is a four-cylinder design (constructed by duplicating the two-cylinder design and attaching them side-by-side) with the sets of pistons rotating 180 degrees out of phase, vibration would be cancelled, and the counterweights would be unnecessary. This can be accomplished by having all four rotating pistons drive a single flywheel as shown in FIG. 8. In this case, the upper pistons are not exactly 180 degrees out of phase with the lower ones, but are close to 180 An alternative method would be to have two flywheels and crankshafts, and the two flywheels would have gear teeth on the circumference that would mesh with each other. This provides a very smooth running motor.

Figure 9:
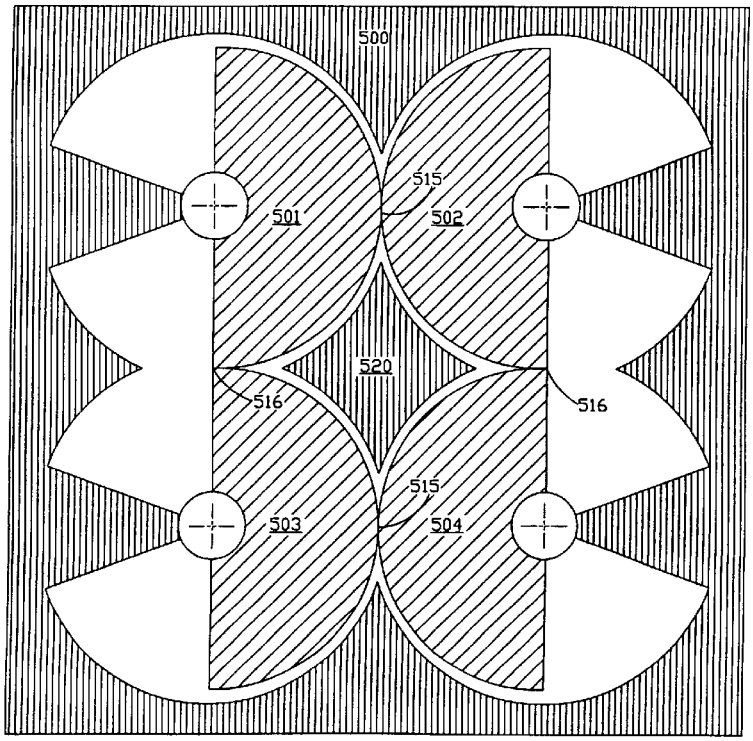
FIG. 9 is a radial cross-section view of a four-piston configuration of the present invention.

An alternative geometry to cancel vibration is shown in FIG. 9, which is a cross section through the rotating pistons and engine block. Four rotating pistons 501, 502, 503, and

504 are mounted in engine block 500. On the end plate of this design, all four gear wheels (not shown) would mesh to keep the rotating pistons appropriately aligned. Note that the center of mass of the upper pistons moves downward as the center of mass of the lower ones moves upward.

Left and right pistons roll together at contact point 515. During part of the cycle, the upper and lower pistons roll together at contact points 516. It is not really necessary that the pistons touch at point 516 for proper function of the engine, but since all four gear wheels must mesh, the pistons will touch there. The body 520 occupies the space between the pistons to prevent unused gas from occupying that space. This body is held in place by attachment to the end plates. It could contain channels for cooling water. These methods of reducing vibration apply to all versions of MECH.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An apparatus comprising:

a block defining therein a first cylinder parallel to a second cylinder, said cylinders radially intersecting to provide a passage there between along their respective lengths;

a first piston pivotally disposed within said first cylinder and a second piston pivotally disposed within said second cylinder, said first piston parallel to said second piston, each of said pistons cyclically rotatable eccentrically about the axis of its respective cylinder and having a maximum radial dimension from said axis, said pistons mutually contacting along a common axial line of rolling contact in said passage, wherein said maximum radial dimension for each of said pistons approximately equals the distance between the piston's respective axis of rotation and said line of rolling contact;

an oscillating compression volume and an oscillating expansion volume in each of said cylinders, said volumes defined by each said cylinder and its corresponding piston; and valves for alternatively closing and opening said compression volumes and alternatively closing and opening said expansion volumes at the conclusion of each half cycle of rotation of the corresponding piston;

wherein at each half cycle of rotation, the direction of rotation of each of said pistons about its corresponding axis reverses, and wherein said pistons have opposite angular directions of rotation, and wherein said common line of contact defines a rolling seal physically isolating said compression volumes from said expansion volumes.

2. An apparatus according to claim 1 further comprising a first gearwheel attached to a first axial shaft extending from said first piston and a second gearwheel attached to a second axial shaft extending from said second piston, wherein said first and second gearwheels have intermeshing teeth to maintain said pistons in operating relationship.

3. An apparatus according to claim 2 further comprising an oil pump for lubrication in operable connection with said first gearwheel, said pump comprising a chamber and plunger, whereby when said first gearwheel oscillates, said plunger forces oil out of said chamber.

4. An apparatus according to claim 1 or 2 wherein said pistons, said cylinders and said valves comprise a four-cycle combustion engine.

5. An apparatus according to claim 1 or 2 wherein said pistons, said cylinders and said valves comprise a two-cycle combustion engine.

6. An apparatus according to claim 1 or 2 wherein said pistons, said cylinders and said valves comprise an expander apparatus having a high pressure intake and a low pressure output.

7. An apparatus according to claim 6 wherein said pistons, said cylinders and said valves comprise an hydraulic motor having an high pressure intake port for high pressure hydraulic fluid and a low pressure fluid output.

8. An apparatus according to claim 1 or 2 wherein said pistons, said cylinders and said valves comprise a compressor apparatus having a low pressure intake and a high pressure output.

9. An apparatus according to claim 8 wherein said pistons, said cylinders and said valves comprise an hydraulic pump having a low pressure intake port for low pressure hydraulic fluid and a high pressure fluid output.

10. An apparatus according to claim 2 further comprising a crank rod connected to one of said gearwheels for transition between oscillating rotating movement and continuous rotation.

11. An apparatus for combusting, compressing, or expanding a fluid, comprising:

a block defining at least one pair of parallel cylinders therein, said pair of cylinders comprising a first cylinder and a second cylinder, each of said cylinders having an arcuate wall and said cylinders radially intersecting to define a passage there between along their respective lengths;

at least one pair of pistons, a first one of said pistons pivotally disposed within said first cylinder and a second one of said pistons pivotally disposed within said second cylinder, each piston cyclically rotatable eccentrically about the axis of a corresponding cylinder, said pistons mutually contacting along a common axial line of rolling contact;

a gap defined between each cylinder wall and its corresponding piston, wherein said pistons do not rub said arcuate walls;

a first oscillating compression volume and a first oscillating expansion volume, said first volumes defined by said first cylinder and said first piston;

a second oscillating compression volume and a second oscillating expansion volume, said second volumes defined by said second cylinder and said second piston; and valves for alternatively closing and opening said compression volumes and alternatively closing and opening said expansion volumes at the conclusion of each half cycle of rotation of said pistons;

wherein at each half cycle of its rotation, the direction of rotation of each of said pistons about said axis reverses;

wherein said pistons rotate about parallel axes, said pistons having opposite angular directions of rotation, and wherein said common line of contact between said pistons defines a rolling seal physically isolating said compression volumes from said expansion volumes.

12. An apparatus according to claim 11 further comprising:

gearwheels, at least one of said gearwheels in operable connection with each of said pistons, said gearwheels having intermeshing teeth on their respective circumferences;

a crank rod pivotally attached to one of said gearwheels;

a flywheel, driven by said crank rod via a pivoting shaft.

13. An apparatus according to claim 11 further comprising a first gearwheel attached to a first axial shaft extending from said first piston and a second gearwheel attached to a second axial shaft extending from said second piston, wherein said first and second gearwheels have intermeshing teeth to maintain said pistons in operating relationship.

14. An apparatus according to claim 13 further comprising an oil pump for lubrication in operable connection with said first gearwheel, said pump comprising a chamber and a plunger, whereby when said first gearwheel oscillates, said plunger forces oil out of said chamber.

15. An apparatus according to claim 11 comprising a plurality of pairs of cylinders and a plurality of pairs of pistons.

16. An apparatus according to claim 11 wherein said apparatus comprises a hydraulic pump.

17. An apparatus according to claim 11 wherein said apparatus comprises a compressor.

18. An apparatus according to claim 11 wherein said apparatus comprises a hydraulic motor.

19. An apparatus according to claim 11 wherein said apparatus comprises an expander.

20. An apparatus according to claim 11 further comprising:

end plates covering ends of said pistons;

radial end seals between said pistons and said end plates.

21. An apparatus according to claim 11 wherein said apparatus comprises an internal combustion engine.

* * * * *